US008460471B2

(12) United States Patent
Takeshima et al.

(10) Patent No.: US 8,460,471 B2
(45) Date of Patent: Jun. 11, 2013

(54) METHOD FOR GLYCOSYLATING AND SEPARATING PLANT FIBER MATERIAL

(75) Inventors: Shinichi Takeshima, Numazu (JP); Takeshi Kikuchi, Sakura (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 374 days.

(21) Appl. No.: 12/995,756

(22) PCT Filed: Jun. 2, 2009

(86) PCT No.: PCT/IB2009/005928

§ 371 (c)(1),
(2), (4) Date: Dec. 2, 2010

(87) PCT Pub. No.: WO2009/147523

PCT Pub. Date: Dec. 10, 2009

(65) Prior Publication Data

US 2011/0082291 A1 Apr. 7, 2011

(30) Foreign Application Priority Data

Jun. 3, 2008 (JP) ..... 2008-145737

(51) Int. Cl.
*C13K 1/02* (2006.01)

(52) U.S. Cl.
CPC ..... *C13K 1/02* (2013.01)
USPC ..... 127/37

(58) Field of Classification Search
USPC ..... 127/37
See application file for complete search history.

(56) References Cited

U.S. PATENT DOCUMENTS

| | | | | |
|---|---|---|---|---|
| 2,959,500 | A | 11/1960 | Schlapfer et al. | |
| 3,652,425 | A | 3/1972 | Wilson | |
| 4,237,110 | A | 12/1980 | Forster et al. | |
| 4,743,669 | A | 5/1988 | Young | |
| 5,380,341 | A | 1/1995 | Matthews et al. | |
| 7,947,656 | B2 | 5/2011 | Yamasaki et al. | |
| 2010/0126501 | A1 | 5/2010 | Takeshima et al. | |
| 2010/0189706 | A1 | 7/2010 | Chang et al. | |
| 2011/0082291 | A1* | 4/2011 | Takeshima et al. | 536/128 |
| 2011/0105744 | A1* | 5/2011 | Takeshima et al. | 536/128 |
| 2011/0120454 | A1* | 5/2011 | Takeshima et al. | 127/37 |
| 2011/0180062 | A1* | 7/2011 | Takeshima et al. | 127/37 |
| 2011/0315138 | A1* | 12/2011 | Takeshima et al. | 127/37 |

FOREIGN PATENT DOCUMENTS

| | | |
|---|---|---|
| DE | 713610 | 11/1941 |
| EP | 1 860 201 A1 | 11/2007 |
| JP | 56-30334 A | 3/1981 |
| JP | 59-124901 | 7/1984 |

(Continued)

OTHER PUBLICATIONS

Makoto Misono, et al., Solid superacid catalysts, Chemtech, Nov. 1993, pp. 23-29.

(Continued)

*Primary Examiner* — David M Brunsman
(74) *Attorney, Agent, or Firm* — Finnegan, Henderson, Farabow, Garrett & Dunner, LLP

(57) ABSTRACT

The invention relates to a method for hydrolyzing a plant fiber material to produce and separate a saccharide including glucose. The method includes a hydrolysis process of using a cluster acid catalyst in a pseudo-molten state to hydrolyze cellulose contained in the plant fiber material, and produce glucose. The cluster acid catalyst is subjected to a clustering enhancing treatment by which clustering of the cluster acid catalyst in a crystalline state is enhanced.

15 Claims, 6 Drawing Sheets

1. GLYCOSYLATION REACTION

FOREIGN PATENT DOCUMENTS

| | | | |
|---|---|---|---|
| JP | 61-118420 | | 6/1986 |
| JP | 3-93755 | | 4/1991 |
| JP | 04-226940 | A | 8/1992 |
| JP | 7-41462 | | 2/1995 |
| JP | 7-215900 | | 8/1995 |
| JP | 8-299000 | | 11/1996 |
| JP | 9-176206 | | 7/1997 |
| JP | 10-137599 | | 5/1998 |
| JP | 10-327900 | | 12/1998 |
| JP | 11-240852 | | 9/1999 |
| JP | 11-343301 | | 12/1999 |
| JP | 2000-103758 | A | 4/2000 |
| JP | 2002-59118 | | 2/2002 |
| JP | 2002-85100 | | 3/2002 |
| JP | 2004-241307 | | 8/2004 |
| JP | 2004-256370 | | 9/2004 |
| JP | 2006-129735 | | 5/2006 |
| JP | 3802325 | | 5/2006 |
| JP | 2006-149343 | | 6/2006 |
| JP | 2006-206579 | | 8/2006 |
| JP | 2007-104983 | | 4/2007 |
| JP | 2008-271787 | | 11/2008 |
| JP | 4240138 | | 1/2009 |
| KR | 1996-0008643 | | 6/1996 |
| WO | WO 95/26438 | | 10/1995 |
| WO | WO 2006/011479 | A1 | 2/2006 |
| WO | WO 2007/026817 | A1 | 3/2007 |
| WO | WO 2008/132605 | A1 | 11/2008 |
| WO | WO 2009/031469 | A1 | 3/2009 |

OTHER PUBLICATIONS

Office Action issued by the U.S. Patent and Trademark Office in U.S. Appl. No. 12/995,784, mailed Apr. 25, 2012.
Office Action for U.S. Appl. No. 12/597,176 mailed Mar. 10, 2011.
Decision of Refusal in Japanese Patent Appln. No. 2007-115407, dated May 17, 2011.
Notification of Reason(s) for Refusal in Japanese Patent Appln. No. 2007-115407, dated Aug. 23, 2011.
Makoto Misono, Unique acid catalysis of heteropoly compounds (heteropolyoxometalates) in the solid state, Chem. Commun., Jul. 7, 2001, No. 13 pp. 1141-1152.
Toru Nishimura, et al., High Catalytic Activities of Pseudoliquid Phase of Dodecatungstophosphoric Acid for Reactions of Polar Molecules, Chemistry Letters, 1991, pp. 1695-1698.
Makoto Misono, et al., Solid superacid catalysts, Chemtech, Nov. 1993, pp. 23-28.
Toko Kengaku, et al., Michael addition in the pseudoliquid phase of heteropoly compounds, Journal of molecular Catalysis A: Chemical 134, 1998, pp. 237-242.
Toshio Okuhara, et al., Catalysis by Heteropoly Compounds, Journal of Catalysis 93, 1985, pp. 224-230.
Office Action dated Jan. 9, 2012, for U.S. Appl. No. 12/597,176.
Reply to Office Action filed Jun. 9, 2011 in U.S. Appl. No. 12/597,176.
S. Takeshima et al., U.S. Appl. No. 12/674,427, "Method of Saccharification and Separation for Plant Fiber Materials," filed Feb. 20, 2010.
K. Arai et al., "Hydrolysis of Cellulose Fiber in the Presence of 12-Tungstosilicic Acid," Journal of Applied Polymer Science, vol. 30, No. 7, pp. 3051-3057 (Jul. 1985).
K. Arai et al., "Hydrolysis of Carbohydrates in the Presence of a Heteropolyacid," Makromol. Chem., Rapid Commun., vol. 4, pp. 181-185 (1983).
International Search Report in International Application No. PCT/IB2009/005928, Mailing Date: Aug. 24, 2009.
Written Opinion of the International Searching Authority in International Application No. PCT/IB2009/005928, Mailing Date: Aug. 24, 2009.
Notification of Reason(s) for Refusal in JP 2008-145737; Drafting Date: Jan. 7, 2010.
G.-W. Wang et al., "Phosphotungstic Acid Catalyzed Amidation of Alcohols," Eur. J. Org. Chem., pp. 4367-4371 (2008).
Notification of Transmittal of the International Search Report and the Written Opinion of the International Searching Authority, or the Declaration, for PCT/IB2009/005920, dated Aug. 24, 2009.
Notification of Reason(s) for Refusal dated Jan. 19, 2010 for Japanese Appl. No. JP 2008-145741.
C. Yow et al., "Hydrolysis of Palm Olein Catalyzed by Solid Heteropolyacids," Journal of the American Oil Chemists' Society, vol. 79, No. 4, pp. 357-361 (2002).
Tong-hao, W. et al., "The Synthesis and Characterization of Molybdophosphoric Acid with Dawson Structure," 1991.
Kozhevnikov, I., "Catalysis by Heteropoly Acids and Multicomponent Polyoxometalates in Liquid-Phase Reactions," Chem. Rev., vol. 98, 1998, pp. 171-198.
Piao, D., et al., "An efficient partial oxidation of methane in trifluoracetic acid using vanadium-containing heteropolyacid catalysts,", Journal of Organometallic Chemistry, vol. 574, 1999, pp. 116-120.
Notification of Reason(s) for Refusal dated Jan. 7, 2010 for Japanese Appl. No. JP 2008-145732.
International Search Report and Written Opinion for PCT/IB2009/005927 dated Aug. 25, 2009.
International Search Report for PCT/IB2008/001528, dated Oct. 9, 2008.
Office Action dated Jan. 20, 2011, for U.S. Appl. No. 12/597,176.
Takeshima et al., U.S. Appl. No. 12/597,176, filed Oct. 23, 2009.
Takeshima et al., U.S. Appl. No. 12/995,784, filed Dec. 2, 2010.
Takeshima et al., U.S. Appl. No. 12/995,809, filed Dec. 2, 2010.

* cited by examiner

1. GLYCOSYLATION REACTION

METHOD FOR GLYCOSYLATING AND SEPARATING PLANT FIBER MATERIAL

CROSS-REFERENCE TO RELATED APPLICATIONS

This application is a national phase application of International Application No. PCT/IB2009/005928, filed Jun. 2, 2009, and claims the priority of Japanese Application No. 2008-145737, filed Jun. 3, 2008, the contents of both of which are incorporated herein by reference.

BACKGROUND OF THE INVENTION

1. Field of the Invention

The invention relates to a method for producing a saccharide including glucose by glycosylating a plant fiber material, and separating the obtained saccharide.

2. Description of the Related Art

It has been suggested to produce a saccharide mainly including glucose or xylose, from cellulose or hemicellulose by degrading a plant material, which is a biomass, such as squeezed sugarcane residues (bagasse) or wood chips and effectively use the produced saccharide as food or fuel, and this process has been put into practice. In particular, a technology by which a monosaccharide obtained by degrading plant fibers is fermented to produce an alcohol such as ethanol as fuel has attracted attention. A variety of methods have been heretofore suggested for producing a saccharide such as glucose by degrading cellulose or hemicellulose (for example, Japanese Patent Application Publication No. 8-299000 (JP-A-8-299000), Japanese Patent Application Publication No. 2006-149343 (JP-A-2006-149343), Japanese Patent Application Publication No. 2006-129735 (JP-A-2006-129735), and Japanese Patent Application Publication No. 2002-59118 (JP-A-2002-59118)), and a typical method includes hydrolyzing cellulose by using sulfuric acid such as dilute sulfuric acid or concentrated sulfuric acid or hydrochloric acid (JP-A-8-299000). A method in which cellulase enzyme is used (JP-A-2006-149343), a method in which a solid catalyst such as activated carbon or zeolite is used (JP-A-2006-129735), and a method in which pressurized hot water is used (JP-A-2002-59118) are also available.

However, a problem associated with the method by which cellulose is degraded by using an acid such as sulfuric acid is that the acid serving as a catalyst and the produced saccharide are difficult to separate from the hydrolysis reaction mixture obtained by hydrolysis. This is because glucose that is the main component of the cellulose hydrolysis product and the acid that serves as a hydrolysis catalyst are both soluble in water. Removal of the acid by neutralization or ion exchange from the hydrolysis reaction mixture is not only troublesome and costly, but it is also difficult to remove the acid completely and the acid often remains in the process of fermentation for ethanol. As a result, even when pH is optimized from the standpoint of activity of yeast in the process of fermentation for ethanol, concentration of salt increases, thereby reducing the yeast activity and decreasing the fermentation efficiency.

In particular, when concentrated sulfuric acid is used, the sulfuric acid is very difficult to remove to the extent such that yeast is not deactivated in the process of fermentation for ethanol and such a removal requires significant energy. By contrast, when dilute sulfuric acid is used, the sulfuric acid is relatively easy to remove. However it is necessary to degrade cellulose under high temperature conditions, which is energy consuming. In addition the acid such as sulfuric acid and hydrochloric acid is very difficult to separate, collect, and reuse. Thus, the use of these acids as a catalyst for producing glucose is a cause of increased cost of bio-ethanol.

With the method in which pressurized hot water is used, it is difficult to adjust the conditions, and it is difficult to produce glucose with a stable yield. In addition, in this method, even glucose is degraded, thereby reducing the yield of glucose. Moreover, the activity of yeast is reduced by degraded components and fermentation may be inhibited. Another problem is associated with cost because the reactor (supercritical processing apparatus) is expensive and has poor durability.

SUMMARY OF THE INVENTION

The inventors have conducted a comprehensive study of glycosylation of cellulose and have discovered that a cluster acid in a pseudo-molten state has excellent catalytic activity with respect to cellulose hydrolysis and can be easily separated from the produced saccharide. Patent applications that cover the respective method have already been filed (Japanese Patent Application No. 2007-115407 and Japanese Patent Application No. 2007-230711). According to the present method, by contrast with the conventional method using concentrated sulfuric acid or dilute sulfuric acid, the hydrolysis catalyst can be recovered and reused and energy efficiency of the process leading to the recovery of aqueous saccharide solution and recovery of hydrolysis catalyst from the product obtained by hydrolyzing cellulose can be increased. Furthermore, the aforementioned patent applications also suggest a method for separating a saccharide produced by the hydrolysis of a plant fiber material and the cluster acid catalyst. More specifically, a method is suggested by which an organic solvent is added after hydrolysis to a reaction mixture including the produced saccharide and the cluster acid catalyst, whereby the cluster acid is dissolved, and the saccharide is separated as a solid fraction together with a residue from the cluster acid and organic solvent.

The inventors have further advanced the research of cellulose glycosylation using the cluster acid catalyst and have successfully increased the selectivity of the cluster acid catalyst with respect to glycosylation reaction of plant fiber material. Thus, the invention is based on the results obtained in the course of this research and provides a method for glycosylating and separating a plant fiber material by using the cluster acid catalyst in a pseudo-molten state, in which the advancement of a dehydration reaction (hyperreaction) of saccharide by the cluster acid catalyst is inhibited, the cellulose hydrolysis reaction is caused to proceed with high selectivity, and yield of saccharide is increased.

The first aspect of the invention relates to a method for glycosylating and separating a plant fiber material to produce and separate a saccharide including glucose. The method includes a hydrolysis process of using a cluster acid catalyst in a pseudo-molten state to hydrolyze cellulose contained in the plant fiber material, and produce glucose, wherein the cluster acid catalyst is subjected to a clustering enhancing treatment by which clustering of the cluster acid catalyst in a crystalline state is enhanced. With the glycosylation and separation method in accordance with the invention, a dehydration reaction (hyperreaction) of saccharide including glucose that is produced by hydrolysis of the plant fiber material is inhibited and yield of saccharide is increased.

By subjecting the cluster acid catalyst to a clustering enhancing treatment at a point in time at which an amount of the plant fiber material that can be charged in one cycle for the entire reaction system is charged in the hydrolysis process, that is, at a point in time at which the main operation of the hydrolysis process is started, it is possible to inhibit effectively the hyperreaction of the monosaccharide produced in the hydrolysis process.

Clustering of the cluster acid catalyst by the clustering enhancing treatment can be confirmed by several methods, for example, by an infrared (IR) spectrum. More specifically, when the cluster acid catalyst crystallizes, the cluster acid catalyst takes in water as water of crystallization and has an absorption peak in the vicinity of 3200 $cm^{-1}$, but when the crystals are destroyed and a cluster state is become, an absorption peak is located in the vicinity of 3500 $cm^{-1}$. Therefore, when an IR spectrum of the cluster acid catalyst before the clustering enhancing treatment and an IR spectrum of the cluster acid catalyst after the clustering enhancing treatment are compared, the cluster acid catalyst can be confirmed to be clustered by the clustering enhancing treatment in a case where a peak intensity in the vicinity of 3200 $cm^{-1}$ that is derived from an $H_2O$ molecule that is sandwiched between crystals of the cluster acid catalyst after the clustering enhancing treatment is less than that of the cluster acid catalyst before the clustering enhancing treatment, and a peak intensity in the vicinity of 3500 $cm^{-1}$ that is derived from an OH group bound to a strong acid of the cluster acid catalyst after the clustering enhancing treatment is greater than that of the cluster acid catalyst before the clustering enhancing treatment.

A specific method of the clustering enhancing treatment includes a process of heating and stirring the cluster acid catalyst and an organic solvent that can dissolve the cluster acid catalyst, and a process of removing the organic solvent after the heating and stirring process. In this case, the cluster acid catalyst and the organic solvent may be heated and stirred at a temperature equal to or lower than 65° C.

In a case where the method in accordance with the invention includes a saccharide separation process of adding an organic solvent in which the cluster acid catalyst can be dissolved to a reaction mixture after the hydrolysis process and solid-liquid separating the obtained mixture into a liquid fraction including the cluster acid catalyst and the organic solvent and a solid fraction including the saccharide, a specific method of the clustering enhancing treatment includes a process of adding a cluster acid catalyst in a crystalline state in an amount that replenishes a loss of the cluster acid catalyst in the saccharide separation process to the organic solvent solution of cluster acid that is obtained in the saccharide separation process and formed by dissolution of the cluster acid catalyst in the organic solvent, and then performing heating and stirring.

Another method of the clustering enhancing treatment includes heating and stirring part of the amount of the plant fiber material that can be charged in one cycle together with the cluster acid catalyst in the pseudo-molten state and performing hydrolysis of the plant fiber material in the hydrolysis process. In this case, in the clustering enhancing treatment, the amount of the plant fiber material that is heated and stirred together with the cluster acid catalyst in the pseudo-molten state is equal to or less than 10 wt. % the amount of the plant fiber material that can be charged in one cycle. Furthermore, the plant fiber material may be heated and stirred together with the cluster acid catalyst in the pseudo-molten state in an amount that does not change a viscosity of the cluster acid catalyst in the pseudo-molten state.

Yet another method of the clustering enhancing treatment includes heating and stirring of the cluster acid catalyst in a pseudo-molten state. In this case, heating and stirring are performed at a temperature that is higher by at least 5 to 10° C. than a temperature at which the state of the cluster acid catalyst starts to be changed to a pseudo-molten state. The cluster acid catalyst may be heated and stirred with water in an amount such that the ratio of water of crystallization of the cluster acid catalyst becomes equal to or greater than 100%.

In accordance with the invention, in glycosylating and separating a plant fiber material by using a cluster acid catalyst in a pseudo-molten state, the advancement of a dehydration reaction (hyperreaction) of monosaccharide by the cluster acid catalyst can be inhibited. Therefore, in accordance with the invention, cellulose hydrolysis reaction is caused to proceed with high selectivity, and yield of monosaccharide can be increased. Furthermore, the reaction rate of the hydrolysis reaction can be increased.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein.

DETAILED DESCRIPTION OF EMBODIMENTS

A method for glycosylating and separating a plant fiber material in accordance with the invention is a method for hydrolyzing a plant fiber material to produce and separate a saccharide mainly including glucose. This method includes a hydrolysis process of using a cluster acid catalyst in a pseudo-molten state to hydrolyze cellulose contained in the plant fiber material, and produce glucose, wherein the cluster acid catalyst is subjected to a clustering enhancing treatment by which clustering of the cluster acid catalyst in a microcrystalline state and/or polycrystalline state is enhanced.

In the above-mentioned patent applications (Japanese Patent Application No. 2007-115407 and Japanese Patent Application No. 2007-230711), the inventors disclosed a method for glycosylating and separating a plant fiber material in which a cluster acid is heated to obtain a pseudo-molten state and used as a hydrolysis catalyst for the plant fiber material. The results of the investigation conducted by the inventors demonstrated that in the method for glycosylating and separating plant fiber material by using the cluster acids, in a case where an unused new cluster acid reagent is used, a dehydration reaction (hyperreaction) of monosaccharide, such as produces glucose, proceeds after the initial state of the hydrolysis reaction (more specifically 10 min since the reaction has started at a reaction temperature of 70° C.), but no dehydration of monosaccharide proceeds thereafter (more specifically, after 10 min since the reaction has started at a reaction temperature of 70° C.). Because the monosaccharide dehydration reaction decreases the yield of saccharide, it is important that this reaction be sufficiently inhibited. The reaction temperature of the hydrolysis process can be reduced to inhibit the saccharide dehydration reaction, but such an approach results in an extended reaction time and can decrease the reaction stability.

Figure 3:
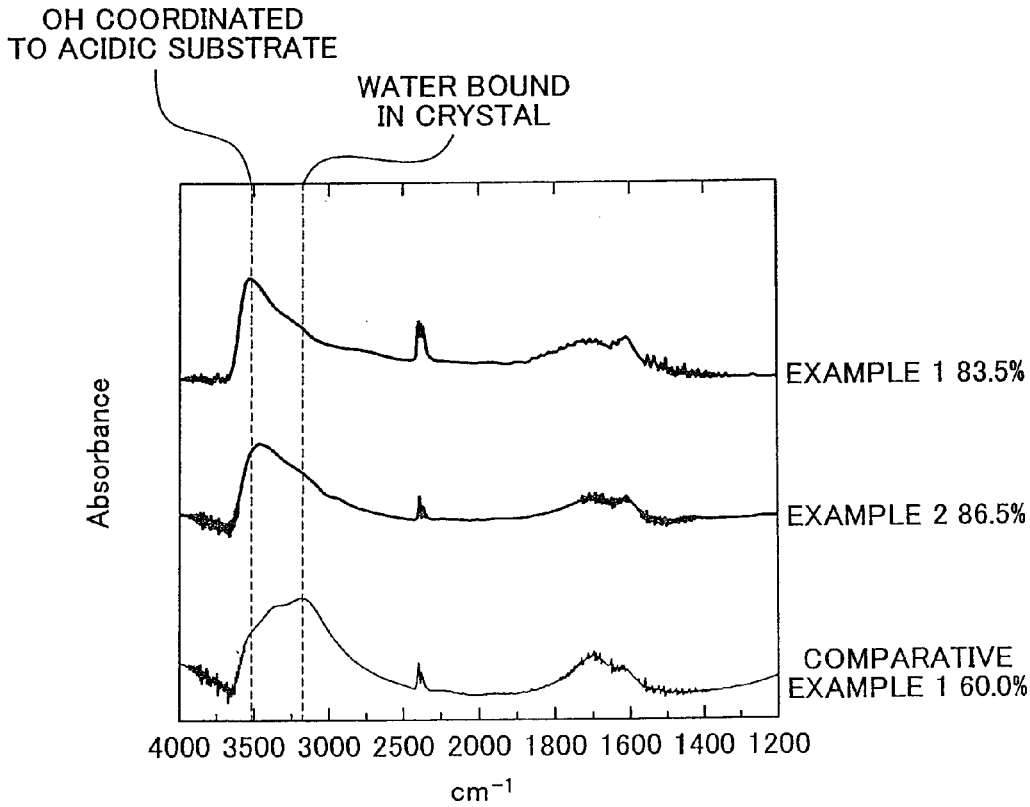
FIG. 3 shows the results of IR measurements in Example 1, Example 2, and Comparative Example 1.

Accordingly, the inventors have conducted a state analysis of heteropoly acids that are representative examples of a cluster acids by IR spectroscopy (see FIG. 3). More specifically, IR measurements were conducted with respect to the following heteropoly acids (A), (B), and (C). (A): a heteropoly acid obtained by dissolving an unused new heteropoly acid reagent in ethanol at room temperature (20 to 25° C.), then evaporating ethanol, and drying (see Comparative Example 1); (B) a heteropoly acid obtained by stirring an unused new heteropoly acid reagent and ethanol under heating at a temperature of 60° C., decreasing the temperature to 45° C., evacuating the inside of the stirring vessel, rapidly evaporating the ethanol, and drying (see Example 1); and (C) a heteropoly acid obtained by adding an unused heteropoly acid reagent to ethanol containing a heteropoly acid that has been used as a hydrolysis catalyst of a plant fiber material (ratio of the used heteropoly acid to the unused heteropoly acid is 9:1), stirring under heating at 50° C., evacuating the inside of the stirring vessel, rapidly evaporating the ethanol, and drying (see Example 2).

As a result, the IR measurements of the heteropoly acid (A) confirmed that the heteropoly acid contained $H_2O$ molecules bound in a crystal (an absorption peak in the vicinity of 3200 $cm^{-1}$ shown in FIG. 3), thereby demonstrating that the heteropoly acid (A) contained heteropoly acid in a crystalline state. Furthermore, when the heteropoly acid (A) was used as a hydrolysis catalyst for a plant fiber material, the saccharide yield was 60%. By contrast, a peak shift was observed in the IR measurements of the heteropoly acids (B) and (C). More specifically, the absorption peak of $H_2O$ molecules bound in a crystal (absorption peak in the vicinity of 3200 $cm^{-1}$ shown in FIG. 3) decreased, and the absorption peak of OH groups located on a strongly acidic substrate (absorption peak in the vicinity of 3500 $cm^{-1}$ shown in FIG. 3) increased. Thus, it was found that the heteropoly acids changed to a cluster state constituted by a number of heteropoly acid molecules in the hydrolysis process of the plant fiber material or due to heating and stirring in ethanol that can dissolve the heteropoly acids. Furthermore, when the heteropoly acids (B) and (C) were used as hydrolysis catalysts for a plant fiber material, the yield of saccharide was 83.5% with the heteropoly acid (B) and 86.5% with the heteropoly acid (C), thereby demonstrating a significant increase in saccharide yield over that in the case the heteropoly acid (A) was used.

The above-described results suggest that because the heteropoly acid in a crystalline state, such as the heteropoly acid (A), demonstrates significant polarization and an excessively high acid strength, the hyperreaction of monosaccharide occurs. Furthermore, it can be assumed that because the acid strength of the heteropoly acid in a cluster state, such as heteropoly acids (B) and (C) is more suitable than that of the heteropoly acid in a crystalline state, the hyperreaction of monosaccharide does not occur and the hydrolysis reaction of plant fiber material can selectively proceed. The acid strength of a cluster acid in a crystalline state is higher than that of the heteropoly acid in a cluster state apparently because of the increase in polarization caused by crystallization.

The invention is based on the above-described information. Thus, a cluster acid catalyst in a crystalline state has a high acid strength and causes a dehydration reaction (hyperreaction) of monosaccharide, whereas a cluster acid catalyst in a cluster state does not cause the dehydration reaction of the produced monosaccharide and induces, hydrolysis of the plant fiber material with high selectivity. Thus, in accordance with the invention, the increase in saccharide yield is made possible by subjecting a cluster acid catalyst to a treatment that enhances clustering. Because, the clustering enhancing treatment increases the diffusion rate of cluster acid catalyst in a hydrolysis reaction system, an effect of increasing the hydrolysis reaction rate can be also obtained.

In accordance with the invention, the cluster acid used as a catalyst for hydrolyzing the plant fiber material means an acid in which a plurality of oxoacids are condensed, that is, a so-called polyacid. In most polyacids, it is known that in polyacids, a plurality of oxygen atoms are bounded to a central element, and as a result the polyacids are oxidized to the extent that the oxidation umber becomes maximum, and the polyacids demonstrate excellent properties as an oxidation catalyst, and the polyacids are strong acids. For example, the acid strength of phosphotungstic acid (pKa=−13.16), which is a heteropoly acid, is higher than the acid strength of sulfuric acid (pKa=−11.93). Thus, even under mild temperature conditions, such as a temperature of 50° C., for example, it is possible to degrade cellulose or hemicellulose to produce a monosaccharide, such as glucose or xylose.

The cluster acid used in the invention may be either a homopoly acid or a heteropoly acid, but a heteropoly acid is preferred because it has a high oxidizing power and a high acid strength. The heteropoly acid that can be used is not particularly limited. For example, the heteropoly acid can be represented by the general formula HwAxByOz (A stands for a heteroatom, B stands for a polyatom that serves as a polyacid skeleton, w stands for a composition ratio of hydrogen atoms, x stands for a composition ratio of heteroatoms, y stands for a composition ratio of polyatoms, and z stands for a composition ratio of oxygen atoms). Examples of the polyatom B include atoms such as W, Mo, V, and Nb that can form the polyacid. Examples of the heteroatom A include atoms such as P, Si, Ge, As, and B that can form a heteropoly acid. The number of kinds of the polyatoms and heteroatoms that are contained in a single molecule of the heteropoly acid may be one or more.

Because of good balance of acid strength and the oxidizing power, it is preferred that phosphotungstic acid $H_3[PW_{12}O_{40}]$ or silicotungstic acid $H_4[SiW_{12}O_{40}]$, which are tungstates, be used. Phosphomolybdic acid $H_3[PMo_{12}O_{40}]$, which is a molybdate, also can be advantageously used.

Figure 1:
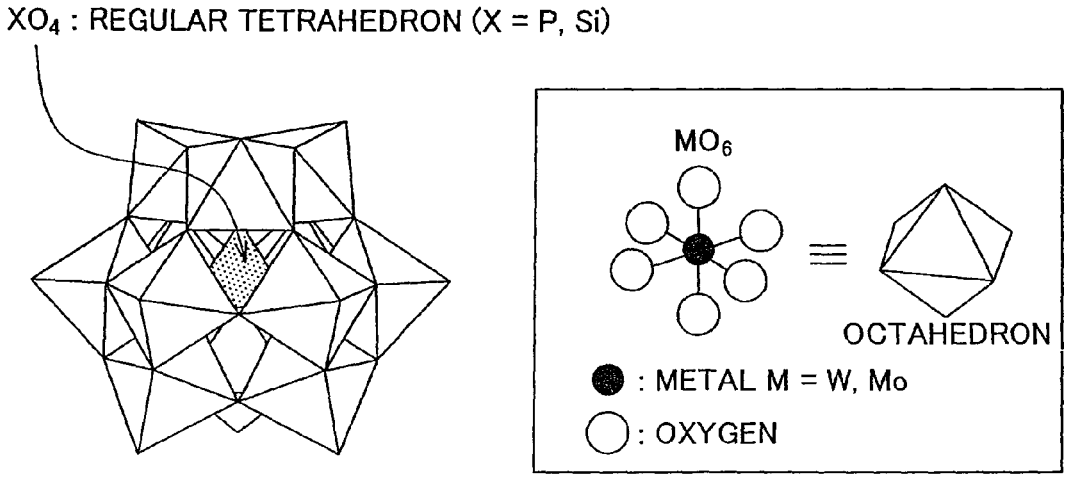
FIG. 1 shows a Keggin structure of a heteropoly acid.

The structure of a Keggin-type $[X^{n+}M_{12}O_{40}$: X=P, Si, Ge, As, etc., M=Mo, W, etc.] heteropoly acid (phosphotungstic acid) is shown in FIG. 1. A tetrahedron $XO_4$ is present at the center of a polyhedron constituted by octahedron $MO_6$ units, and a large amount water of crystallization is present around this structure. The structure of the cluster acid is not particularly limited and can be not only of the Keggin type, but also, for example, of a Dawson type. Here water that is hydrated or coordinated to the cluster acid catalyst in a crystalline state or the cluster acid catalyst in a cluster state constituted by several molecules of the cluster acid catalyst is described by a generally used term "water of crystallization". The water of crystallization includes anion water that is hydrogen-bonded to the anion constituting the cluster acid catalyst, coordination water that is coordinated to the cation, lattice water that is not coordinated to the cation or anion, and also water that is contained in the form of OH groups. The cluster acid catalyst in a cluster state is an association constituted by one to several molecules of cluster acids and is different from a crystal. The cluster acid catalyst in a cluster state can be in a solid state, a pseudo-molten state, and in a state of dissolution in a solvent (colloidal state).

The above-described cluster acid catalyst is in a solid state at normal temperature, but the state thereof becomes a pseudo-molten state when heated to a higher temperature. The pseudo-molten state as referred to herein means a state in which the cluster acid is apparently melted but is not completely melted into a liquid state; the pseudo-molten state resembles a colloidal (sol) state in which the cluster acid is dispersed in a liquid, and is a state in which the cluster acid shows fluidity. Whether the cluster acid is in the pseudo-molten state can be confirmed by visual observations, or in the case of a homogeneous system, by DSG (Differential Scanning Calorimetry).

As described above, the cluster acid exhibits a high catalytic activity to the hydrolysis of cellulose even at low temperatures due to a high acid strength of the cluster acid. Because the diameter of a molecule of the cluster acid is about 1 to 2 nm, typically slightly larger than 1 nm, the cluster acid is easily mixed with the plant fiber material, which is the raw material, and therefore efficiently promotes hydrolysis of cellulose. Thus, it is possible to hydrolyze cellulose under mild temperature conditions with high energy efficiency and low environmental load.

In addition, by contrast with the conventional method for hydrolysis of cellulose that uses an acid such as sulfuric acid, the method in accordance with the invention that uses a cluster acid as a catalyst, the separation efficiency of the saccharide and catalyst is high and they can be easily separated. Because the cluster acid is in a solid state at a certain temperature, it can be separated from the saccharide, which is the product. Therefore, the separated cluster acid can be recovered and reused. Furthermore, because the cluster acid catalyst in a pseudo-molten state also functions as a reaction solvent, the amount of solvent used as the reaction solvent can be greatly reduced by comparison with that of the conventional method. It means that separation of the cluster acid and the saccharide, which is the product, and the recovery of the cluster acid can be performed at an increased efficiency. Thus, the invention in which the cluster acid is used as the cellulose hydrolysis catalyst can reduce cost and decrease environmental load.

Whether the clustering of the cluster acid catalyst has advanced can be determined, for example, by IR measurements, Raman spectroscopy, nuclear magnetic resonance (NMR), and the like.

For example, in IR measurements, the determination can be made by observing a spectrum of water (the aforementioned water of crystallization) that is coordinated to the cluster acid and comparatively evaluating the intensity of absorption peak (in the vicinity of 3200 $cm^{-1}$) derived from $H_2O$ molecule bound in a crystal and an absorption peak (in the vicinity of 3500 $cm^{-1}$) derived from an OH group bound to a strongly acidic substrate. More specifically, when an IR spectrum of the cluster acid catalyst before the clustering enhancing treatment and an IR spectrum of the cluster acid catalyst after the clustering enhancing treatment are compared, in a case where a peak intensity in the vicinity of 3200 $cm^{-1}$ that is derived from $H_2O$ molecule bound in a crystal of the cluster acid catalyst after the clustering enhancing treatment is less than that of the cluster acid catalyst before the clustering enhancing treatment, and a peak intensity in the vicinity of 3500 $cm^{-1}$ that is derived from an OH group bound to a strongly acidic substrate of the cluster acid catalyst after the clustering enhancing treatment is greater than that of the cluster acid catalyst before the clustering enhancing treatment, it can be determined that clustering has advanced. In IR measurements, the absorption peak derived from an $H_2O$ molecule is not limited to the absorption of the absorption peak derived from OH groups bound to a strongly acidic substrate and generally can be observed as a broad peak.

Figure 4:
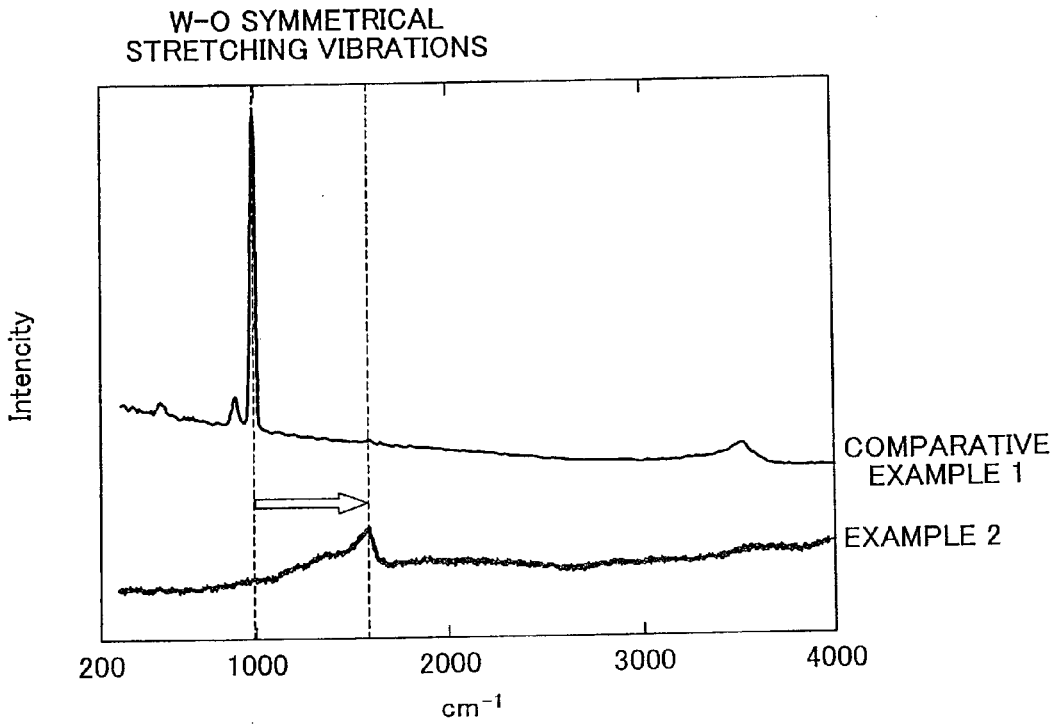
FIG. 4 shows the results of Raman spectroscopy measurements in Example 2 and Comparative Example 1.
Figure 5:
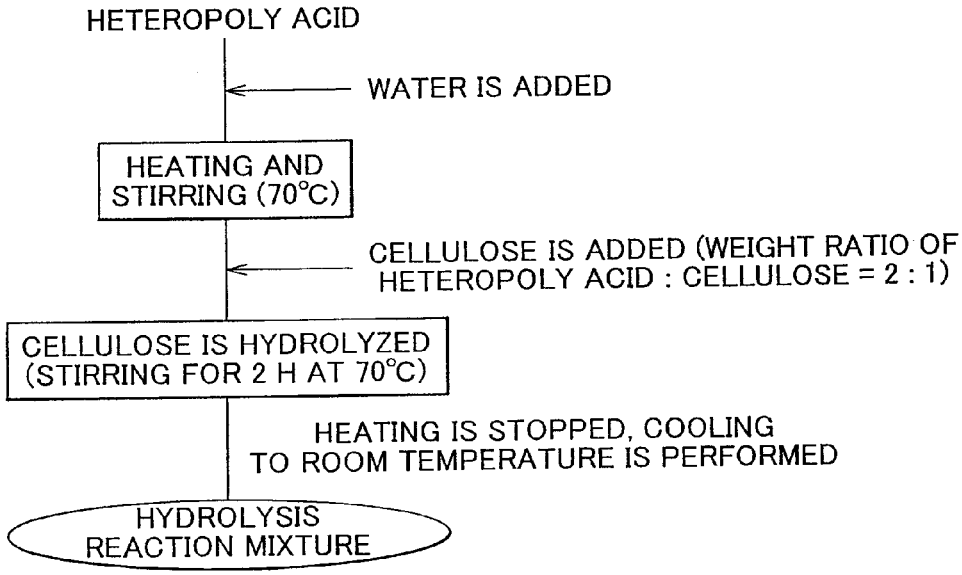
FIG. 5 shows a procedure of the hydrolysis process in the examples.

Furthermore, in Raman spectroscopy, for example, where the attention is focused on symmetrical stretching vibrations of a $WO_6$ octahedron of phosphotungstic acid, a sharp high scattering peak is observed in the vicinity of 985 $cm^{-1}$ in the cluster acid catalyst in a crystalline state before the clustering treatment (see Comparative Example 1 in FIG. 4). However, in the cluster acid catalyst in a cluster state after the clustering treatment, a shift to a higher frequency in the vicinity of 1558 $cm^{-1}$ occurs, and the peak intensity decreases significantly, that is, sensitivity decreases (see Example 2 in FIG. 4). Such shift to a higher frequency and decrease in sensitivity are caused by the below-described structural changes induced by clustering of the cluster acid catalyst. In the $WO_6$ octahedron, because the ion radius of W is as small as 0.074 nm, the spacing between the W and O is extremely tight, as shown in FIG. 1. Where surface energy is stabilized by clustering and the shape is deformed closer to the spherical shape, the symmetry of $WO_6$ decreases and the distance between W and O becomes even shorter. As a result, the decrease in sensitivity and increase in bonding strength cause simultaneous scattering and shift to a higher frequency. This phenomenon is not intrinsic to phosphotungstic acid and similarly occurs in other cluster acids. Therefore, the cluster state of the cluster acid catalyst can be confirmed by observing structural changes in the cluster acid catalyst by Raman spectroscopy.

In accordance with the invention, a specific method of clustering enhancing treatment is not particularly limited, provided that a cluster acid can be converted into the above-described cluster state. A specific clustering enhancing treatment recommended in accordance with the invention is performed before the hydrolysis process that uses the cluster acid as a hydrolysis catalyst for the plant fiber material, but as described hereinabove, the cluster acid can be separated from the produced saccharide after the hydrolysis process, recovered, and reused again as a hydrolysis catalyst. Therefore, the clustering enhancing treatment can be performed in the hydrolysis process or saccharide separation process before the reuse. Accordingly, initially each process of the method for glycosylating and separating a plant fiber material by using a cluster acid catalyst will be described below and then the clustering enhancing treatment of the cluster acid catalyst will be explained.

In accordance with the invention, the cluster acid catalyst is subjected to a clustering enhancing treatment at a point in time at which an amount of the plant fiber material that can be charged in one cycle for the entire reaction system is charged in the hydrolysis process, that is, at a point in time at which the main operation of the hydrolysis process is started. As a result, it is possible to inhibit effectively the hyperreaction of the monosaccharide produced in the hydrolysis process. "The plant fiber material in an amount that can be charged in one cycle" as referred to in the present description is the amount that enables the state of the mixture to become a completely homogeneous mixed and kneaded state when this amount is mixed with the cluster acid catalyst (amount used in the hydrolysis process) in a pseudo-molten state that is used in the hydrolysis process. In this case, the plant fiber material in the mixture is not in a dry state. Because the amount of the plant fiber material that can be charged in one cycle changes depending on the type of the kneading machine, this amount cannot be determined uniquely, but it is generally preferred that the weight ratio (plant fiber material:cluster acid catalyst) of the plant fiber material in an amount that can be charged in one cycle and the cluster acid catalyst in a pseudo-molten state that is used in the hydrolysis process be 1:2 to 1:6. In the present description, "a point in time at which an amount of the plant fiber material that can be charged in one cycle for the entire reaction system is charged in the hydrolysis process" means a point in time at which the amount of the plant fiber material that is mixed with the cluster acid catalyst that is used in the hydrolysis process reaches "the amount that can be charged in one cycle" in the hydrolysis process.

First, a hydrolysis process will be described in which cellulose contained in the plant fiber material is hydrolyzed and a saccharide mainly including glucose is produced. In the explanation below, the attention is focused on the process in which glucose is mainly produced from cellulose, but a process in which hemicellulose is included in addition to cellulose in the plant fiber material and a process in which the product includes other monosaccharides such as xylose in addition to glucose also fall within the scope of the invention.

The plant fiber material is not particularly limited, provided that it includes cellulose or hemicellulose, and examples thereof include cellulose-based biomass, such as broad-leaved trees, bamboos, coniferous trees, kenaf, scrap wood from furniture, rice straws, wheat straws, rice husks, and squeezed sugarcane residues (bagasse). The plant fiber material may be the cellulose or hemicellulose that is separated from the biomass, or may be the cellulose or hemicellulose that is artificially synthesized. Such fiber materials are usually used in the pulverized form to improve dispersivity in the reaction system. The method for pulverizing may be a commonly used method. From the standpoint of facilitating mixing with the cluster acid catalyst and reaction, it is preferred that the plant fiber material be pulverized to a powder with a diameter of about a few microns to 200 μm.

Furthermore, lignin contained in the fiber material may be dissolved, if necessary, by performing a pulping treatment in advance. By dissolving and removing the lignin, it is possible to increase the probability of contact between the cluster acid catalyst and cellulose in the hydrolysis process and, at the same time, reduce the amount of residue contained in the hydrolysis reaction mixture and inhibit the decrease in the saccharide yield or cluster acid recovery ratio caused by admixing of the produced saccharide or cluster acid to the residue. In a case where the pulping treatment is performed, the degree of grinding of the plant fiber material can be comparatively small (coarse grinding). The resultant effect is that labor, cost, and energy required for pulverizing the fiber material can be reduced. The pulping treatment can be performed, for example, by bringing the plant fiber material (for example, from several centimeters to several millimeters) into contact with an alkali or a salt such as NaOH, KOH, $Ca(OH)_2$, $Na_2SO_3$, $NaHCO_3$, $NaHSO_3$, $Mg(HSO_3)_2$, $Ca(HSO_3)_2$, an aqueous solution thereof, a mixture thereof with a $SO_2$ solution, or a gas such as $NH_3$ under steam. Specific conditions include a reaction temperature of 120 to 160° C. and a reaction time of several tens of minutes to about 1 h.

The sequence in which the cluster acid catalyst and plant fiber material are charged into a reaction container is not particularly limited. For example, the cluster acid catalyst may be charged into a reaction container and heated to obtain a pseudo-molten state, and then the plant fiber material may be charged. Alternatively, the cluster acid catalyst and plant fiber material may be charged together and then heated to bring the cluster acid catalyst into a pseudo-molten state. In a case where the cluster acid catalyst and plant fiber material are heated after charging, the cluster acid catalyst and plant fiber material are preferably mixed and stirred in advance, prior to heating. The degree of contact between the cluster acid and plant fiber material can be increased by conducting mixing to a certain degree before the cluster acids is brought into a pseudo-molten state. As described hereinabove, because the state of the cluster acid catalyst becomes a pseudo-molten state and functions as a reaction solvent in the hydrolysis process, in accordance with the invention, it is possible to use no water or organic solvent as a reaction solvent in the hydrolysis process, but water or organic solvent may be required depending on the form (size, state of fibers, etc.) of the plant fiber material, mixing ratio and volume ratio of the cluster acid catalyst and plant fiber material, and the like.

Figure 2:
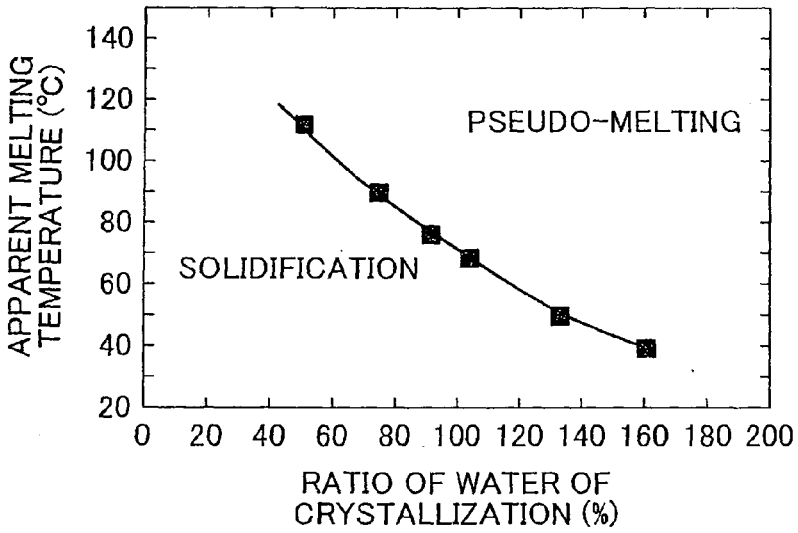
FIG. 2 is a graph showing a relationship between the ratio of water of crystallization in a cluster acid catalyst and an apparent melting temperature.

The pseudo-molten state of the cluster acid changes depending on temperature and amount of water of crystallization contained in the cluster acid catalyst (see FIG. 2). More specifically, where the amount of water of crystallization contained in phosphotungstic acid, which is a cluster acid, is high, the temperature at which the acid demonstrates a pseudo-molten state decreases. Thus, a cluster acid catalyst containing a large amount of water of crystallization demonstrates a catalytic effect on the cellulose hydrolysis reaction at a temperature lower than that of the cluster acid catalyst with a relatively small amount of water of crystallization. In other words, by controlling the amount of water of crystallization contained in the cluster acid catalyst in the reaction system of the hydrolysis process, it is possible to bring the cluster acid catalyst into a pseudo-molten state at the target hydrolysis reaction temperature. For example, when phosphotungstic acid is used as the cluster acid catalyst, it is possible to control the hydrolysis reaction temperature within the range between 40 and 110° C. by changing the amount of water of crystallization in the cluster acid (see FIG. 2).

FIG. 2 shows a relationship between the ratio of water of crystallization in the heteropoly acid (phosphotungstic acid), which is a typical cluster acid catalyst, and the temperature (apparent melting temperature) at which the state of the cluster acid catalyst starts to be changed to a pseudo-molten state, and the cluster acid catalyst is in a solid state in the region under the curve, and in a pseudo-molten state in the region above the curve. Furthermore, in FIG. 2, the ratio of water of crystallization (%) is a value obtained under the assumption that a standard amount of water of crystallization n (n=30) in the cluster acid (phosphotungstic acid) is 100%. Because no component of cluster acid catalyst is thermally decomposed and volatilized even at a high temperature such as 800° C., the amount of water of crystallization can be specified by a pyrolytic method (TG measurements).

The standard amount of water of crystallization as referred to herein is the amount (the number of molecules) of water of crystallization contained in one molecule of the cluster acid in a solid state at room temperature, and the standard amount varies depending on the kind of cluster acid. For example, the standard amount of water of crystallization is about 30 in phosphotungstic acid ($H_3[PW_{12}O_{40}].nH_2O$ (n≈30)), about 24 in silicotungstic acid ($H_4[SiW_{12}O_{40}].nH_2O$ (n≈24)), and about 30 in phosphomolybdic acid ($H_3[PMo_{12}O_{40}].nH_2O$ (n≈30)).

The amount of water of crystallization contained in the cluster acid catalyst can be regulated by controlling the amount of water present in the hydrolysis reaction system. Specifically, when it is desired to increase the amount of water of crystallization contained in the cluster acid catalyst, that is, to lower the reaction temperature, it is possible to add water to the hydrolysis reaction system, for example, by adding water to the mixture containing the plant fiber material and the cluster acid catalyst or by raising the relative humidity of the atmosphere of the reaction system. As a result, the cluster acid takes in the added water as water of crystallization, and the apparent melting temperature of the cluster acid catalyst is lowered.

By contrast, when it is desired to reduce the amount of water of crystallization contained in the cluster acid catalyst, that is, to raise the reaction temperature, it is possible to reduce the amount of water of crystallization contained in the cluster acid catalyst by removing water from the hydrolysis reaction system, for example, by heating the reaction system to evaporate water, or adding a desiccant agent to the mixture containing the plant fiber material and the cluster acid catalyst. As a result, the apparent melting temperature of the cluster acid catalyst is raised. As described above, it is possible to control easily the amount of water of crystallization contained in the cluster acid, and it is also possible to regulate easily the reaction temperature at which cellulose is hydrolyzed, by controlling the amount of water of crystallization.

Furthermore, it is preferred that the desired amount of water of crystallization of the cluster acid catalyst can be ensured even when the relative humidity of the reaction system is decreased by heating in the hydrolysis process. Specifically, a method can be used by which a saturated vapor pressure state is produced at the hydrolysis reaction temperature inside a pre-sealed reaction container, so that the atmosphere of the reaction system at a predetermined reaction temperature is under the saturated vapor pressure, the temperature is lowered to condensate the vapors, while maintaining the sealed state, and the condensed water is added to the plant fiber material and cluster acid catalyst. Furthermore, in a case where the plant fiber material containing moisture is used, it is preferred that the amount of moisture contained in the plant fiber material also be taken into account as the amount of moisture present in the reaction system; this is not particularly necessary in a case where the dry plant fiber material is used.

The advantage of lowering the reaction temperature in the hydrolysis process is that the energy efficiency can be increased. Selectivity of glucose production in the hydrolysis of cellulose contained in the plant fiber material varies depending on a temperature in the hydrolysis process. The reaction efficiency generally rises as the reaction temperature rises. For example, as described in Japanese Patent Application No. 2007-115407, in the hydrolysis reaction of cellulose using phosphotungstic acid with a ratio of water of crystallization of 160%, the reaction ratio R at a temperature of 50 to 90° C. rises with the increase in temperature and almost the entire cellulose reacts at about 80° C. The glucose yield $\eta$ shows a similar trend to increase at 50 to 60° C., reaches a peak at 70° C. and then decreases. Thus, glucose is produced with high selectivity at 50 to 60° C., but at 70 to 90° C., reactions other than glucose production also proceed, such as production of other saccharides such as xylose and formation of decomposition products. Therefore, the reaction temperature of hydrolysis is an important factor that governs the selectivity of cellulose reaction ratio and selectivity of glucose production, and it is preferable that the hydrolysis reaction temperature be low in view of energy efficiency. However, it is preferred that the temperature of hydrolysis reaction be determined by taking into account also the cellulose reaction ratio and glucose production selectivity.

Further, water is necessary for hydrolyzing cellulose in the hydrolysis process. More specifically, (n−1) molecules of water are required to degrade cellulose in which (n) glucoses have been polymerized into (n) glucoses (n is a natural number). Therefore, in a case where a sum total of the amount of water of crystallization that is necessary to bring the cluster acid into a pseudo-molten state at the reaction temperature and the amount of water necessary to hydrolyze the entire charged amount of cellulose into glucose is not present in the reaction system, the water of crystallization of the cluster acid catalyst is used for hydrolysis of cellulose, the amount of water of crystallization of the cluster acid catalyst decreases, and the cluster acid solidifies. Thus, the degree of contact between the cluster acid catalyst and the plant fiber material or the viscosity of the mixture of the plant fiber material and the cluster acid catalyst increases and a long time is required to mix the mixture sufficiently.

Therefore, in order to ensure the functions of the cluster acid catalyst as a reaction solvent and a catalyst at the reaction temperature in the hydrolysis process, that is, in order to enable the cluster acid catalyst to maintain the pseudo-molten state, it is preferred that the amount of water in the reaction system satisfy the following condition. Thus, it is preferred that the amount of water in the reaction system be equal to or greater than the sum total of (a) the amount of water of crystallization necessary for the entire cluster acid catalyst present in the reaction system to be in the pseudo-molten state at the reaction temperature in the hydrolysis process and (b) the amount of water necessary for the entire amount of cellulose present in the reaction system to be hydrolyzed into glucose. It is especially preferred that the sum total of (a) and (b) be added. This is because, if an excessive amount of water is added, the produced saccharide and cluster acid are dissolved in the surplus water, thereby making the separation process of the saccharide and the cluster acid complicated.

In the hydrolysis process, there is a case where the amount of water in the reaction system decreases and the amount of water of crystallization of the cluster acid catalyst also decreases, thereby the cluster acid catalyst becomes solid and the degree of contact with the plant fiber material and mixing ability of the reaction system degrades. The occurrence of such problems can be avoided by increasing the hydrolysis temperature so that the cluster acid catalyst is brought into the pseudo-molten state.

As described above, temperature conditions in the hydrolysis process may be appropriately determined with consideration for several factors (for example, reaction selectivity, energy efficiency, cellulose reaction ratio, etc.), but from the standpoint of balance of energy efficiency, cellulose reaction ratio, and glucose yield, the temperature of equal to or lower than 140° C. is usually preferred, and the temperature of equal to or lower than 120° C. is especially preferred. Depending on the form of the plant fiber material, a low temperature of equal to or lower than 100° C. can be also used. In this case, glucose can be produced with especially high energy efficiency.

The pressure in the hydrolysis process is not particularly limited, but because the catalytic activity of the cluster acid catalyst with respect to the cellulose hydrolysis reaction is high, the cellulose hydrolysis can be advanced with good efficiency even under mild pressure conditions such as a range from a normal pressure (atmospheric pressure) to 1 MPa.

The ratio of the plant fiber material and cluster acid catalyst differs depending on the properties (for example, size and the like) and type of the plant fiber material used and a stirring method or mixing method used in the hydrolysis process. Therefore, although this ratio may be appropriately determined correspondingly to the implementation conditions, the preferred ratio of the cluster acid catalyst to the plant fiber material (weight ratio) is preferably within a range of 2:1 to 6:1, and usually may be about 2:1 to 4:1. Because the mixture including the cluster acid catalyst and the plant fiber material in the hydrolysis process has a high viscosity, for example, a ball mill using heating can be advantageously used, but a typical stirring device may be also used.

The duration of the hydrolysis process is not particularly limited and may be appropriately set according to the shape of the plant fiber material used, ratio of the plant fiber material and the cluster acid catalyst, catalytic activity of the cluster acid catalyst, reaction temperature, reaction pressure, and the like.

Where the temperature of reaction system decreases after the end of hydrolysis is decreased, the saccharide produced in the hydrolysis process becomes an aqueous saccharide solution when water, which dissolved the saccharide, is present in the hydrolysis reaction mixture including the cluster acid catalyst, and where no water is present, the saccharide precipitates and is contained in the solid state. Part of the produced saccharide can be present in the form of aqueous solution and the balance can be contained in the form of a mixture in the solid state. Because the cluster acid catalyst is also soluble in water, where a sufficient amount of water is contained in the mixture after the hydrolysis process, the cluster acid catalyst is also dissolved in water.

A saccharide separation process in which the saccharide (mainly including glucose) produced in the hydrolysis process and the cluster acid catalyst are separated will be described below. In the glycosylating and separating method in accordance with the invention, a method for separating the saccharide and the cluster acid is not limited to the below-described method.

The reaction mixture after the hydrolysis process (can be also referred to hereinbelow as "hydrolysis reaction mixture") includes at least the cluster acid catalyst and the produced saccharide. In a case where the amount of water in the hydrolysis process is a sum total of the (a) and (b), the saccharide of the hydrolysis reaction mixture precipitates. Meanwhile, the state of the cluster acid catalyst also becomes a solid state when temperature decreases. Depending on the type of the plant fiber material used, a residue (unreacted cellulose or lignin, etc.) is contained as a solid component in the hydrolysis reaction mixture.

The cluster acid catalyst shows solubility in organic solvents in which the saccharide mainly including glucose, is insoluble or has poor solubility. Therefore, it is possible to add an organic solvent that is a poor solvent for the saccharide and a good solvent for the cluster acid catalyst to the hydrolysis reaction mixture, perform stirring, selectively dissolve the cluster acid catalyst in the organic solvent, and then separate the organic solvent solution containing dissolved cluster acids and a solid component including the saccharide by solid-liquid separation. Depending on the plant fiber material used, a residue or the like can be contained in the solid component including the saccharide. A method for separating the organic solvent solution and the solid component is not particularly limited, and a typical solid-liquid separation method such as decantation and filtration can be used.

The organic solvent is not particularly limited, provided that it is a good solvent for the cluster acid catalyst and a poor solvent for saccharide, but in order to suppress the dissolution of the saccharide in the organic solvent, it is preferred that solubility of the saccharide in the organic solvent be equal to or less than 0.6 g/100 ml, and more preferably equal to or less than 0.06 g/100 ml. In this case, in order to increase the recovery ratio of the cluster acid catalyst, it is preferred that the solubility of the cluster acid in the organic solvent be equal to or greater than 20 g/100 ml, more preferably equal to or greater than 40 g/100 ml.

Specific examples of the organic solvent include alcohols such as ethanol, methanol, n-propanol, and octanol and ethers such as diethylether and diisopropylether. Alcohols and ethers can be advantageously used, and among them, from the standpoint of dissolution ability and boiling point, ethanol and diethylether are preferred. Diethylether does not dissolve saccharides such as glucose and has high ability of dissolving cluster acids. Therefore, diethylether is one of optimum solvents for separating saccharides and cluster acid catalysts. Ethanol also hardly dissolves saccharides such as glucose and has high ability of dissolving cluster acids. Therefore, it is also one of the optimum solvents. Diethylether is superior to ethanol in terms of distillation, but the advantage of ethanol is that it is easier obtainable than diethylether.

The amount of the organic solvent used differs depending on the ability of the solvent to dissolve the saccharide and the cluster acid catalyst and the amount of moisture contained in the hydrolysis reaction mixture. Therefore, the suitable amount of the organic solvent may be appropriately determined.

It is usually preferred that the stirring of the hydrolysis reaction mixture and the organic solvent be performed at a specific temperature within a temperature range of from room temperature to 60° C., the specific temperature depending on the boiling point of the organic solvent. The stirring method of the hydrolysis reaction mixture and the organic solvent is not particularly limited and the stirring may be performed by a typical method. From the standpoint of recovery efficiency of the cluster acid, stirring and grinding with a ball mill is preferred as the stirring method.

In order to increase the recovery ratio of the saccharide and cluster acid and increase the purity of the obtained saccharide, it is preferred that the organic solvent (the organic solvent that is a poor solvent for the saccharide and a good solvent for the cluster acid catalyst) be added to and stirred with the solid component obtained by the aforementioned solid-liquid separation, thereby performing washing with the organic solvent. This is because the cluster acid catalyst that has been admixed to the solid component can be removed and recovered. A mixture in which the organic solvent is added to the solid component can be separated into the solid component and the organic solvent solution of cluster acid by solid-liquid separation in the same manner as in the hydrolysis reaction mixture. If necessary, the solid component can be washed with the organic solvent a plurality of times. By adding water such as distilled water to the solid component obtained by solid-liquid separation, stirring and then performing solid-liquid separation (because the saccharide is soluble in water), it is possible to separate the aqueous saccharide solution from the solid component including the residue or the like.

By removing the organic solvent from the liquid component (organic solvent solution including the cluster acid catalyst dissolved therein) obtained by the solid-liquid separation, it is possible to separate the cluster acid catalyst and the organic solvent and recover the cluster acid catalyst. A method for removing the organic solvent is not particularly limited, except for atmospheric distillation. Examples of suitable methods include vacuum distillation and freeze drying. Among them, vacuum distillation at a temperature of equal to or less than 50° C. is preferred. The recovered cluster acid catalyst can be again used as the hydrolysis catalyst for the plant fiber material. The organic solvent solution including the recovered cluster acid after washing the solid component can be again used for washing the solid component (see FIG. 6).

Depending on the amount of moisture in the hydrolysis process, the hydrolysis reaction mixture can contain an aqueous solution including the saccharide and cluster acid dissolved therein. In this case, the solid component including the saccharide and the organic solvent including the cluster acid catalyst dissolved therein can be separated by removing the moisture from the hydrolysis reaction mixture to precipitate the dissolved saccharide and cluster acid and then adding the organic solvent, stirring and performing solid-liquid separation. It is especially preferred that the amount of moisture in the hydrolysis reaction mixture be adjusted so that the ratio of water of crystallization in the entire cluster acid catalyst contained in the hydrolysis reaction mixture be less than 100%. In a case where the cluster acid catalyst has a large amount of water of crystallization, typically the amount for water of crystallization that is equal to or greater than the standard amount of water of crystallization, the saccharide that is a products is dissolved in the excess moisture, and the recovery ratio of saccharide is decreased by admixing the saccharide to the organic solvent solution including the cluster acid. By reducing the ratio of water of crystallization in the cluster acid catalyst to less than 100%, it is possible to prevent the saccharide from thus admixing to the cluster acid catalyst.

A method that can decrease the amount of moisture in the hydrolysis reaction mixture may be used for reducing the ratio of water of crystallization in the cluster acid catalyst contained in the hydrolysis reaction mixture. Examples of such a method include a method by which the sealed state of the reaction system is released and heating is performed to evaporate the moisture contained in the hydrolysis mixture and a method by which a desiccating agent or the like is added to the hydrolysis mixture and moisture contained in the hydrolysis mixture is removed.

The clustering enhancing treatment of the cluster acid catalyst will be explained below. As described hereinabove, the specific clustering enhancing treatment that is recommended in accordance with the invention is performed before the hydrolysis process in which the cluster acid is used as a hydrolysis catalyst for the plant fiber material, but in a case where the cluster acid recovered by the saccharide separation process is reused, the clustering enhancing treatment can be also implemented in the hydrolysis process or saccharide separation process. Conversion of the cluster acid catalyst into a cluster state is enhanced, for example, by stirring the cluster acid in a pseudo-molten state, or adding the cluster acid to a solvent and stirring under heating, or stirring the cluster acid together with the plant fiber material under heating and causing the cluster acid to act as a hydrolysis catalyst. The following three specific methods can be used for enhancing the conversion into a cluster state. (1) A method for heating and stirring a cluster acid catalyst and an organic solvent that can dissolve the cluster acid catalyst; (2) a method for, in a hydrolysis process in which a plant fiber material is hydrolyzed using a cluster acid catalyst, heating and stirring part of the plant fiber material in an amount that can be charged in one cycle, with the cluster acid catalyst in a pseudo-molten state and performing hydrolysis of the plant fiber material; and (3) a method for heating and stirring a cluster acid catalyst in a pseudo-molten state. These methods (1) to (3) will be described below.

In the method (1) for heating and stirring a cluster acid catalyst and an organic solvent that can dissolve the cluster acid catalyst, the heating temperature may be appropriately set according to the variation in the state of the cluster acid in the solvent, but a temperature of equal to or higher than 30° C. is usually preferred. From the standpoint of preventing the cluster acid catalyst from recrystallizing, it is preferred that the temperature be equal to or lower than 65° C., in particular equal to or lower than 55° C. Examples of organic solvents that can dissolve the cluster acid catalyst include organic solvents that can be used in the above-described saccharide separation process. Among them, from the standpoint of dissolution ability and boiling point, ethanol and methanol are preferred. The mixing ratio of the organic solvent and the cluster acid catalyst is not particularly limited and can be appropriately selected correspondingly to the solubility of the cluster acid catalyst in the organic solvent. The heating and stirring time may be appropriately determined correspondingly to the solubility of the cluster acid catalyst in the organic solvent used and the heating temperature, and usually the heating and stirring time is about 10 min to 60 min or about 30 min to 60 min. The mixing method is not particularly limited and a well-known method can be used.

Even in a case where an unused new cluster acid reagent is used, such heating and stirring of the cluster acid catalyst and the organic acid can convert the state of the cluster acid catalyst into a cluster state and inhibit dehydration reaction of the saccharide in the hydrolysis process. Furthermore, clustering of the reused cluster acid catalyst can be enhanced by adding the organic solvent to the hydrolysis reaction mixture and stirring in the saccharide separation process, and then heating and stirring the organic solvent solution of cluster acid obtained by solid-liquid separation.

The cluster acid catalyst subjected to the clustering enhancing treatment can be separated by removing the organic solvent from the mixture of the cluster acid catalyst and the organic solvent after heating and stirring. In this case, by quickly removing the organic solvent using an evacuation method, it is possible to maintain easily the cluster state of the cluster acid catalyst. More specifically, it is preferred that the organic solvent be removed by vacuum distillation, freeze drying, or the like. The organic solvent can be also removed by heating, but from the standpoint of maintaining the cluster state of the cluster acid, it is preferred that the organic solvent be removed at a low temperature (more specifically, at a temperature of equal to or lower than 65° C.), and it can be said that the aforementioned vacuum distillation and freeze drying are preferred.

Furthermore, clustering of the added cluster acid catalyst and reused cluster acid catalyst can be also enhanced by adding an organic solvent to a hydrolysis reaction mixture and stirring in the saccharide separation process, then adding a cluster acid catalyst in a crystalline state (unused cluster acid reagent or the like) to the organic solvent solution of cluster acid obtained by solid-liquid separation, and stirring under heating. In addition to repeatedly recovering and reusing the cluster acid catalyst, even in a case where the recovered amount of the cluster acid has reduced, it is possible to perform a clustering treatment of the cluster acid catalyst in a crystalline state by adding the cluster acid catalyst in a crystalline state in an amount that replenishes the loss of the cluster acid catalyst in the saccharide separation process, and using the saccharide separation process.

(2) In the method by which part of the plant fiber material in an amount that can be charged in one cycle is stirred under heating with the cluster acid catalyst in a pseudo-molten state and hydrolysis of the plant fiber material is performed in a hydrolysis process, by hydrolyzing only part of the plant fiber material that can be charged in one cycle, it is possible to reduce the amount of monosaccharide that can be dehydrated by the cluster acid catalyst at the initial stage of the hydrolysis process and enhance the clustering of the cluster acid catalyst. After the cluster acid catalyst has become the cluster state, the remaining plant fiber material is additionally charged, thereby making it possible to inhibit the hyperreaction of the saccharide produced from the additionally charged plant fiber material.

"Part of the plant fiber material in an amount that can be charged in one cycle" as referred to herein is part of the aforementioned "plant fiber material in an amount that can be charged in one cycle" and is not limited to a specific amount. Usually it is a very small amount such that the viscosity of the cluster acid catalyst in the pseudo-molten state prior to the addition is maintained even after this amount of the plant fiber material is added to and stirred with the cluster acid catalyst in the pseudo-molten state. Where such very small amount of plant fiber material is initially added to the cluster acid catalyst that is used in the hydrolysis process, the effect of increasing the reaction efficiency as a whole can be expected with such a small sacrifice. A specific amount of the "part of the plant fiber material in an amount that can be charged in one cycle" is preferably equal to or less than 10 wt. %, in particular equal to or less than 5 wt. % of the plant fiber material in an amount that can be charged in one cycle.

The hydrolysis time of the portion of the plant fiber material is not particularly limited and can be set by taking the decrease in viscosity of the hydrolysis mixture as an indicator. Usually, the hydrolysis time is about 10 min to 300 min, or about 60 min to 300 min. Other conditions such as reaction time and pressure can be similar to those of the hydrolysis process.

By conducting hydrolysis of this portion of the plant fiber material with the cluster acid catalyst it is possible to convert the cluster acid catalyst into a cluster and inhibit the dehydration reaction of saccharide in the hydrolysis process, while reducing the amount of monosaccharide dehydrated by the cluster acid catalyst to a minimum even in a case where an unused cluster acid reagent is used. Furthermore, because the clustering treatment of the cluster acid can be implemented by using the hydrolysis process, the increase in difficulty of the manufacturing process can be inhibited.

The method (3) of heating and stirring the cluster acid catalyst in a pseudo-molten state is typically a method by which the cluster acid catalyst is heated and brought to a pseudo-molten state and then is stirring under heating before the plant fiber material and the cluster acid catalyst are mixed in the hydrolysis process. Typically the cluster acid catalyst is heated and stirred to obtain a pseudo-molten state in a reaction container for use in the hydrolysis process and clustering treatment is performed, and then the plant fiber material is added and the hydrolysis process is implemented.

The heating temperature is not particularly limited, provided that the cluster acid can maintain the pseudo-molten state, and can be appropriately set according to the type of cluster acid and ratio of water of crystallization. In order to perform clustering of the cluster acid catalyst with good efficiency, it is preferred that heating be conducted at a temperature that is by at least 10 to 30° C., more preferably by at least 10 to 20° C., even more preferably by at least 5 to 10° C. higher than a temperature at which the state of the cluster acid catalyst starts to be changed to a pseudo-molten state.

The cluster acid catalyst is preferably heated and stirred with water in an amount such that the ratio of water of crystallization of the cluster acid catalyst becomes equal to or higher than 100%. It is especially preferred that the cluster acid catalyst be heated and stirred with water in an amount such that the ratio of water of crystallization of the cluster acid catalyst becomes equal to or higher than 100%, water that is necessary for hydrolysis of the plant fiber material in the subsequent hydrolysis process, and water ensuring the presence of saturated water vapor in the dead volume of the reactor. This is because heating and stirring in the presence of water enhances the transition of the cluster acid catalyst into the pseudo-molten state, thereby enhancing clustering.

The heating and stirring time can be set by taking the decrease in viscosity of the hydrolysis mixture as an indicator. Usually, the heating and stirring time may be 20 to 300 min, or 60 to 300 min. The process of heating and stirring the cluster acid in the pseudo-molten state can be easily included in the already existing process as a preliminary preparatory process for the hydrolysis process using the cluster acid in the pseudo-molten state as a hydrolysis catalyst. Furthermore, the dehydration reaction of monosaccharide in the hydrolysis process can be inhibited even when an unused cluster acid reagent is used.

EXAMPLES

Quantitative determination of D-(+)-glucose and D-(+)-xylose was conducted by high-performance liquid chromatography (HPLC) post-label fluorescence detection method. The cluster acid was identified and quantitatively determined by inductively coupled plasma (ICP).

Example 1

Clustering Enhancing Treatment of Cluster Acid Catalyst

A total of 1 kg of an unused heteropoly acid (phoshotungstic acid) reagent and 500 ml of ethanol were stirred under heating and stirring was conducted for 1, h at a constant temperature of 60° C. The temperature was then lowered to 45° C., the inside of the stirring container was evacuated (evacuation to about 20 kPa), ethanol was rapidly evaporated, and a powdered heteropoly acid subjected to the clustering enhancing treatment was obtained.

A total of 1.0 g of the heteropoly acid subjected to the clustering enhancing treatment was dissolved in 0.5 ml of ethanol and the solution was stirred at room temperature. The ethanol was then evaporated and IR measurements were then conducted under the following conditions. The results are shown in FIG. 3.

(Cellulose Glycosylation and Separation) Distilled water was placed in advance in a sealed reaction container, the temperature was raised to a predetermined reaction temperature (70° C.), a saturated vapor pressure state was obtained inside the container, and water vapor was caused to adhere to the inner surface of the container. Then, 1 kg of a heteropoly acid subjected to the clustering enhancing treatment (amount of water of crystallization has been measured in advance) and distilled water (35 g) in an amount representing shortage of water (water of a saturated vapor pressure component at 70° C. was excluded) with respect to the sum total of the amount necessary to bring water of crystallization of the heteropoly acid to 100% and the amount of water (55.6 g) necessary to hydrolyze entire cellulose and obtain glucose were charged into the container and heated and stirred. Once the temperature inside the container reached 70° C., stirring was further continued for 5 min. Then, 0.5 kg of cellulose was charged in the container and mixing was conducted for 2 h under heating at 70° C. The heating was then stopped, the container was opened, and hydrolysis reaction mixture was cooled to room temperature, while discharging extra water vapor.

Figure 6:
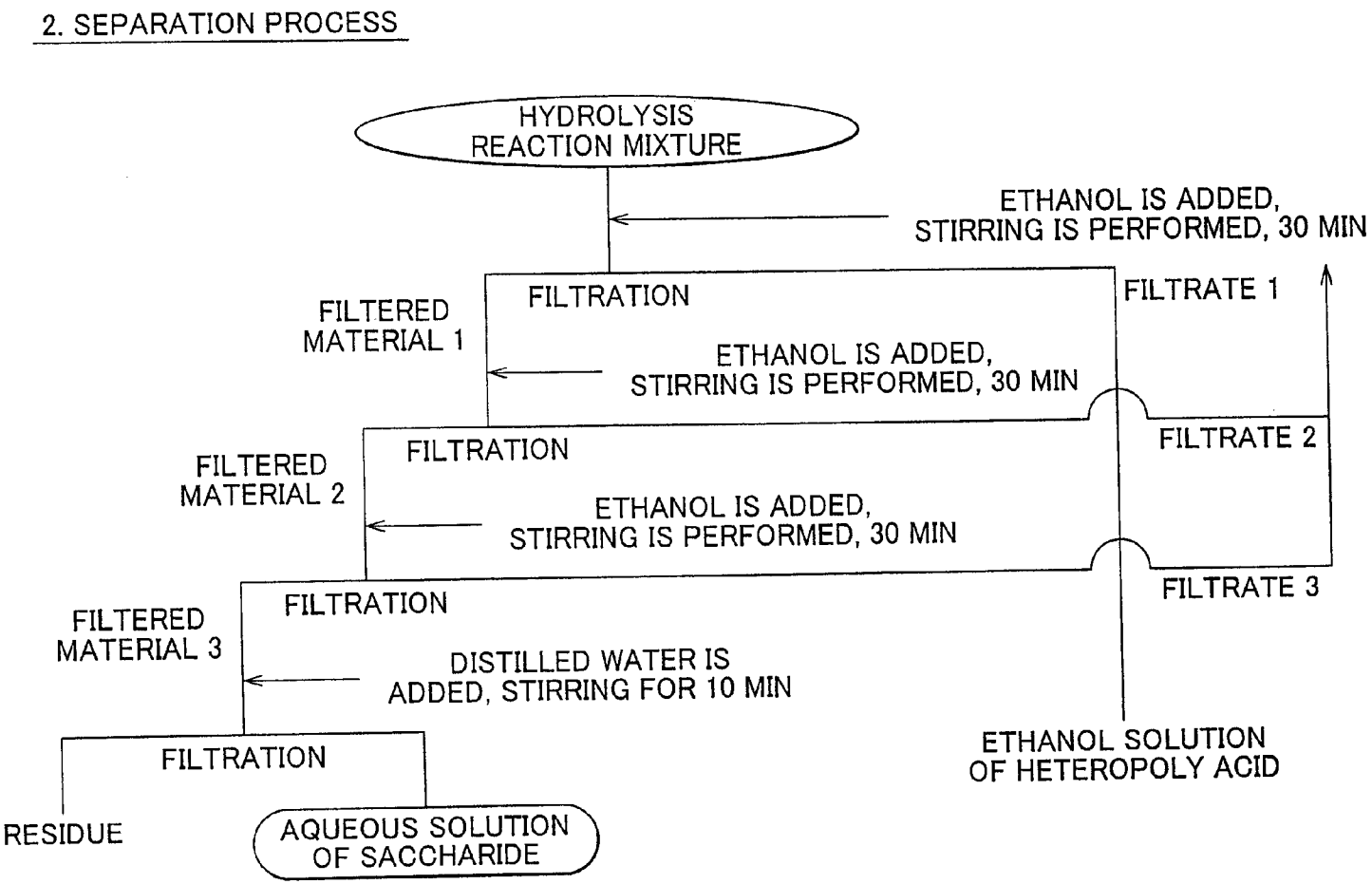
FIG. 6 shows a procedure of the saccharide separation process in the examples.
Figure 7:
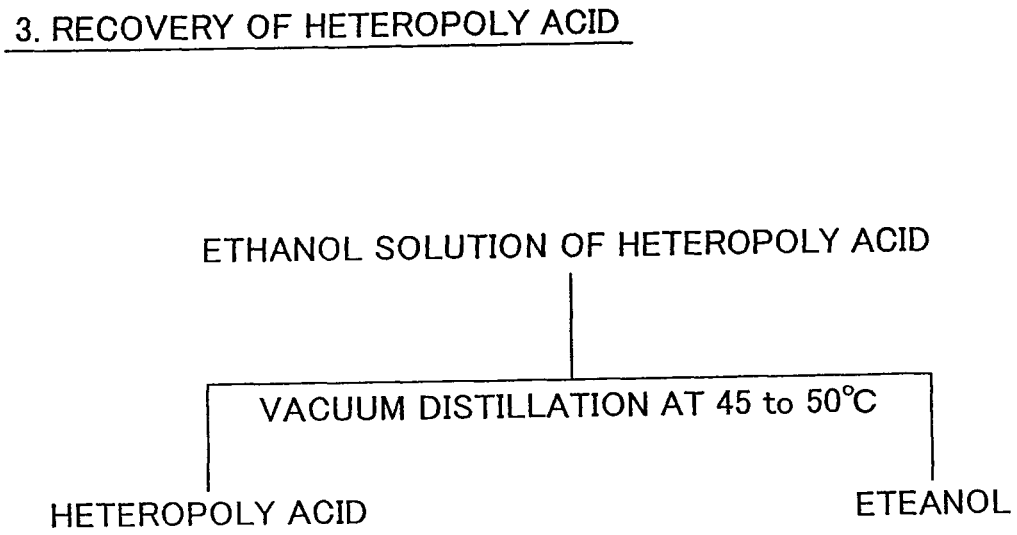
FIG. 7 shows a procedure of the heteropoly acid recovery in the examples.

Then as shown in FIG. 6, a total of 500 ml of ethanol that was twice used for washing was then added to the hydrolysis reaction mixture located inside the container, stirring was conducted for 30 min, followed by filtration that yielded a filtrate 1 and a filtered material 1. The filtrate 1 (ethanol solution of heteropoly acid) was recovered. A total of 500 ml of ethanol that was once used for washing was further added to the filtered material 1 and stirring was conducted for 30 min, followed by filtration that yielded a filtrate 2 and a filtered material 2. A total of 500 ml of new ethanol was added to the filtered material 2 and stirring was conducted for 30 min, followed by filtration that yielded a filtrate 3 and a filtered material 3. Distilled water was added to the obtained filtered material 3 and stirring was conducted for 10 min. No residue could be confirmed to be present in the obtained aqueous solution, but the solution was still filtered and an aqueous saccharide solution was obtained. The yield of monosaccharides (a sum total of glucose, xylose, arabinose, mannose, and galactose) was calculated from the aqueous saccharide solution. The result was 83.5%. As shown in FIG. 7, the filtrates 1 to 3 recovered in the above-described manner (ethanol solutions of heteropoly acid) were subjected to vacuum distillation at 45 to 50° C., ethanol was evaporated, and the heteropoly acid was recovered. The yield of monosaccharides was calculated in the following manner.

Yield of monosaccharides (%): a ratio (weight ratio) of a sum total of actually recovered monosaccharides to a theoretic amount of produced monosaccharides that are produced when the entire amount of charged cellulose is converted into monosaccharides.

Example 2

Clustering Enhancing Treatment of Cluster Acid Catalyst

The hydrolysis of cellulose and separation of saccharide and heteropoly acid were performed and an ethanol solution of the heteropoly acid was recovered in the same manner as in Example 1, except that the heteropoly acid was used that was not subjected to the clustering enhancing treatment. About 100 g of an unused heteropoly acid reagent was added to and dissolved in the recovered ethanol solution of the heteropoly acid (contains heteropoly acid 900 g and ethanol 300 ml) and stirring was performed under heating. After stirring for 20 min at 50° C., evacuation was performed (pressure was reduced to about 20 kPa), the ethanol was evaporated, and a powdered heteropoly acid subjected to the clustering enhancing treatment was obtained.

IR measurements were performed in the same manner as in Example 1 with respect to the heteropoly acid subjected to the clustering enhancing treatment. The results are shown in FIG. 3.

Raman scattering of the obtained powdered heteropoly acid subjected to the clustering enhancing treatment was measured using an Ar laser (488 nm). The results are shown in FIG. 4.

(Cellulose Glycosylation and Separation) Cellulose was hydrolyzed and saccharide and heteropoly acid were separated in the same manner as in Example 1, except that 1 kg of the heteropoly acid subjected to the clustering enhancing treatment in the above-described manner (amount of water of crystallization has been measured in advance) and distilled water (35 g) in an amount representing shortage of water (water of a saturated vapor pressure component at 70° C. was excluded) with respect to the sum total of the amount of water necessary to bring the water of crystallization of the heteropoly acid to 100% and the amount of water (55.6 g) necessary to hydrolyze cellulose and obtain glucose were charged into the container. The yield of monosaccharide was 86.5%.

Example 3

Clustering Enhancing Treatment of Cluster Acid Catalyst and Cellulose Glycosylation and Separation Distilled water was placed in advance in a sealed reaction container, the temperature was raised to a predetermined reaction temperature (70° C.), a saturated vapor pressure state was obtained inside the container, and water vapor was caused to adhere to the inner surface of the container. Then, 1 kg of an unused heteropoly acid (amount of water of crystallization has been measured in advance) and distilled water (35 g) in an amount representing shortage of water (water of a saturated vapor pressure component at 70° C. was excluded) with respect to the sum total of the amount of water necessary to bring the water of crystallization of the heteropoly acid to 100% and the amount of water (55.6 g) necessary to hydrolyze cellulose and obtain glucose were charged into the container and heated and stirred. Once the temperature inside the container reached 70° C., stirring was further continued for 5 min. Then, 0.05 kg of cellulose [10 wt. % of 0.5 kg of the hydrolysis treatment amount (amount that can be charged in one cycle)] was charged into the container and stirring was conducted for 10 min at 70° C. The remaining cellulose, 0.45 kg (90 wt. % of the hydrolysis treatment amount) was then charged and stirring was further continued for 80 min at 70° C. The heating was then stopped, the container was opened, and the hydrolysis reaction mixture was cooled to room temperature, while discharging extra water vapor. The saccharide and heteropoly acid were then recovered from the hydrolysis reaction mixture in the same manner as in Example 1. The monosaccharide yield was 82.1%.

Example 4

Clustering Enhancing Treatment of Cluster Acid Catalyst and Cellulose Glycosylation and Separation Distilled water was placed in advance in a sealed reaction container, the temperature was raised to a predetermined reaction temperature (70° C.), a saturated vapor pressure state was obtained inside the container, and wafer vapor was caused to adhere to the inner surface of the container. Then, 1 kg of an unused heteropoly acid (amount of water of crystallization has been measured in advance), distilled water (35 g) in an amount representing shortage of water (water of a saturated vapor pressure component at 70° C. was excluded) with respect to the sum total of the amount of water necessary to bring water of crystallization of the heteropoly acid to 100% and the amount of water (55.6 g) necessary to hydrolyze cellulose and obtain glucose, and additionally 50 g of distilled water were charged into the container and heated and stirred. Once the temperature inside the container reached 70° C., stirring was further continued for 20 min. Then, 0.5 kg of cellulose was charged into the container and stirring was conducted for 2 h at 70° C. The heating was then stopped, and the hydrolysis reaction mixture was cooled to room temperature. The saccharide and heteropoly acid were then recovered from the hydrolysis reaction mixture in the same manner as in Example 1. The monosaccharide yield was 75.1%.

Comparative Example 1

A total of 1.0 g of unused new heteropoly acid reagent was dissolved in 0.5 ml of ethanol at room temperature (20 to 25° C.). The ethanol was then evaporated, drying was performed, and IR measurements were conducted in the same manner as in Example 1. The results are shown in FIG. 3. The Raman scattering measurements were conducted in the same manner as in Example 2. The results are shown in FIG. 4.

Meanwhile, distilled water was placed in advance in a sealed reaction container, the temperature was raised to a predetermined reaction temperature (70° C.), a saturated vapor pressure state was obtained inside the container, and water vapor was caused to adhere to the inner surface of the container. Then, 1 kg of an unused new heteropoly acid (amount of water of crystallization has been measured in advance) and distilled water (35 g) in an amount representing shortage of water (water of a saturated vapor pressure component at 70° C. was excluded) with respect to the sum total of the amount necessary to bring water of crystallization of the heteropoly acid to 100% and the amount of water (55.6 g) necessary to hydrolyze cellulose and obtain glucose were charged into the container and heated and stirred. Once the temperature inside the container reached 70° C., stirring was further continued for 5 min. Then, 0.5 kg of cellulose was charged and mixing was conducted for 2 h under heating at 70° C. The heating was then stopped, the container was opened, and the hydrolysis reaction mixture was cooled to room temperature, while discharging extra water vapor. Monosaccharides and heteropoly acid were then recovered from the hydrolysis reaction mixture in the same manner as in Example 1. The yield of monosaccharides was 60.0%.

RESULTS

The yield of monosaccharide obtained in Examples 1 to 4 and Comparative Example 1 is shown in Table 1.

TABLE 1

| | Monosaccharide yield |
|---|---|
| Example 1 | 83.5% |
| Example 2 | 86.5% |
| Example 3 | 82.1% |
| Example 4 | 75.1% |
| Comparative Example 1 | 60.0% |

As shown in FIG. 3, when an IR spectrum of the unused new heteropoly acid reagent used in Comparative Example 1 is compared with an IR spectrum of the heteropoly acid subjected to the clustering enhancing treatment that was used in Example 1 and Example 2, in the heteropoly acid subjected to the clustering enhancing treatment that was used in Example 1 and Example 2 the intensity of absorption peak in the vicinity of 3200 $cm^{-1}$ that is derived from $H_2O$ molecule bound in a crystal decreases, the intensity of absorption peak in the vicinity of 3500 $cm^{-1}$ that originates from an OH group coordinated to a strong acid increases, and the clustering is confirmed to have enhanced. Furthermore, as shown in FIG. 4, where Raman spectra of the heteropoly acid subjected to the clustering enhancing treatment that was used in Example 2 and the unused new heteropoly acid reagent used in Comparative Example 1 are compared, in the cluster acid catalyst of Comparative Example 1, a sharp high scattering peak is observed in the vicinity of 985 $cm^{-1}$, but in the cluster acid catalyst of Example 2, a shift to a higher frequency in the vicinity of 1558 $cm^{-1}$ occurs, and the peak intensity decreases significantly, thereby confirming that the clustering is enhanced.

As shown in Table 1, in Examples 1 to 4, the monosaccharide yield was greatly increased with respect to that in Comparative Example 1. This is apparently because in Examples 1 to 4, the heteropoly acid was clustered in a crystalline state by the clustering enhancing treatment of heteropoly acid, whereby the acid strength of the heteropoly acid was reduced and hyperreaction (dehydration reaction) of the monosaccharide in the hydrolysis process of the cellulose was inhibited. In particular, the monosaccharide yield in Examples 1 to 3 exceeded 80% and the saccharide yield improvement effect was increased.

The invention claimed is:

1. A method for hydrolyzing a plant fiber material to produce and separate a saccharide including glucose, comprising:

a hydrolysis process of using a cluster acid catalyst in a pseudo-molten state to hydrolyze cellulose contained in the plant fiber material, and produce glucose, wherein the cluster acid catalyst is subjected to a clustering enhancing treatment by which clustering of the cluster acid catalyst in a crystalline state is enhanced.

2. The method according to claim 1, wherein a temperature of hydrolysis is regulated by regulating an amount of water of crystallization contained in the cluster acid catalyst in the hydrolysis process.

3. The method according to claim 1, wherein the cluster acid catalyst is subjected to a clustering enhancing treatment at a point in time at which an amount of the plant fiber material that can be charged in one cycle for the entire reaction system is charged in the hydrolysis process.

4. The method according to claim 1, wherein when an IR spectrum of the cluster acid catalyst before the clustering enhancing treatment and an IR spectrum of the cluster acid catalyst after the clustering enhancing treatment are compared, a peak intensity in the vicinity of 3200 $cm^{-1}$ that is derived from an $H_2O$ molecule that is sandwiched between crystals of the cluster acid catalyst after the clustering enhancing treatment is less than that of the cluster acid catalyst before the clustering enhancing treatment, and a peak intensity in the vicinity of 3500 $cm^{-1}$ that is derived from an OH group bound to a strong acid of the cluster acid catalyst after the clustering enhancing treatment is greater than that of the cluster acid catalyst before the clustering enhancing treatment.

5. The method according to claim 1, wherein the clustering enhancing treatment comprises a process of heating and stirring the cluster acid catalyst and an organic solvent that can dissolve the cluster acid catalyst, and a process of removing the organic solvent after the heating and stirring process.

6. The method according to claim 5, wherein in the clustering enhancing treatment, the cluster acid catalyst and the organic solvent are heated and stirred at a temperature equal to or lower than 65° C.

7. The method according to claim 5, further comprising:

a saccharide separation process of adding an organic solvent in which the cluster acid catalyst can be dissolved to a reaction mixture after the hydrolysis process and solid-liquid separating the obtained mixture into a liquid fraction including the cluster acid catalyst and the organic solvent and a solid fraction including the saccharide.

8. The method according to claim 7, wherein the clustering enhancing treatment comprises a process of adding a cluster acid catalyst in a crystalline state in an amount that replenishes a loss of the cluster acid catalyst in the saccharide separation process to the organic solvent solution of cluster acid that is obtained in the saccharide separation process and formed by dissolution of the cluster acid catalyst in the organic solvent, and then performing heating and stirring.

9. The method according to claim 1, wherein the clustering enhancing treatment includes heating and stirring part of the amount of the plant fiber material that can be charged in one cycle together with the cluster acid catalyst in the pseudo-molten state and performing hydrolysis of the plant fiber material in the hydrolysis process.

10. The method according to claim 9, wherein in the clustering enhancing treatment, the amount of the plant fiber material that is heated and stirred together with the cluster acid catalyst in the pseudo-molten state is equal to or less than 10 wt. % the amount of the plant fiber material that can be charged in one cycle.

11. The method according to claim, wherein in the clustering enhancing treatment, the amount of the plant fiber material that is heated and stirred together with the cluster acid catalyst in the pseudo-molten state is an amount that does not change a viscosity of the cluster acid catalyst in the pseudo-molten state.

12. The method according to claim 1, wherein the clustering enhancing treatment includes heating and stirring the cluster acid catalyst in a pseudo-molten state.

13. The method according to claim 12, wherein in the clustering enhancing treatment, the cluster acid catalyst is heated and stirred at a temperature that is higher by at least 5 to 10° C. than a temperature at which the cluster acid catalyst starts assuming a pseudo-molten state.

14. The method according to claim 12, wherein in the clustering enhancing treatment, the cluster acid catalyst is heated and stirred with water in an amount such that the ratio of water of crystallization of the cluster acid catalyst becomes equal to or greater than 100%.

15. The method according to claim 1, wherein the cluster acid catalyst is a heteropoly acid subjected to the clustering enhancing treatment.

* * * * *